US006105505A

United States Patent [19]

Jones

[11] Patent Number: 6,105,505

[45] Date of Patent: Aug. 22, 2000

[54] HARD TARGET INCENDIARY PROJECTILE

[75] Inventor: John Willis Jones, Orlando, Fla.

[73] Assignee: Lockheed Martin Corporation, Bethesda, Md.

[21] Appl. No.: 09/098,472

[22] Filed: Jun. 17, 1998

[51] Int. Cl.[7] ..... F42B 10/00

[52] U.S. Cl. ..... 102/364

[58] Field of Search ..... 102/364, 393, 102/489, 293; 104/335, 334

[56] References Cited

U.S. PATENT DOCUMENTS

| | | | |
|---|---|---|---|
| H489 | 7/1988 | Brodman et al. | 102/503 |
| 174,325 | 2/1876 | Tyler | 102/489 |
| 2,402,811 | 6/1946 | Galen | 102/364 |
| 2,417,437 | 3/1947 | Nicholas | 102/364 |
| 2,775,938 | 1/1957 | Wade | 102/364 |
| 2,900,914 | 8/1959 | Ciccone | 102/364 |
| 3,101,053 | 8/1963 | Stevenson et al. | 102/364 |
| 3,208,385 | 9/1965 | Perniss . | |
| 3,302,570 | 2/1967 | Marquardt | 102/364 |
| 3,348,484 | 10/1967 | Grandy . | |
| 3,433,437 | 3/1969 | Bates | 102/364 |
| 3,467,012 | 9/1969 | Lapof . | |
| 3,677,181 | 7/1972 | Giljarhus et al. | 102/364 |
| 3,677,182 | 7/1972 | Peterson | 102/364 |
| 3,797,391 | 3/1974 | Cammarata et al. | 102/364 |

(List continued on next page.)

FOREIGN PATENT DOCUMENTS

| | | | |
|---|---|---|---|
| 583176 | 2/1994 | European Pat. Off. | 102/364 |
| 488407 | 10/1918 | France | 102/364 |
| 501272 | 4/1920 | France | 102/364 |
| 21310 | 8/1920 | France | 102/364 |
| 41097 | 10/1932 | France | 102/364 |
| 2624962 | 6/1989 | France | 102/364 |
| 2679644 | 1/1993 | France | 102/489 |
| 2702556 | 9/1994 | France | 102/364 |
| 307149 | 2/1920 | Germany | 102/364 |
| 2423920 | 12/1974 | Germany | 102/364 |
| 2720695 | 11/1978 | Germany | 102/364 |
| 3326877 | 2/1985 | Germany | 102/489 |
| 3502209 | 7/1986 | Germany | 102/489 |
| 3506889 | 8/1986 | Germany | 102/489 |
| 3540219 | 5/1987 | Germany | 102/489 |
| 3920016 | 1/1991 | Germany | 102/364 |
| 3841124 | 5/1994 | Germany | 102/489 |
| 274286 | 2/1934 | Italy | 102/364 |
| 313968 | 8/1934 | Italy | 102/364 |
| 126022 | 5/1919 | United Kingdom | 102/364 |
| 127265 | 6/1919 | United Kingdom | 102/364 |
| 146146 | 12/1920 | United Kingdom | 102/364 |

*Primary Examiner*—Michael J. Carone
*Assistant Examiner*—Fredrick T. French, III
*Attorney, Agent, or Firm*—Burns, Doane, Swecker & Mathis, LLP

[57] ABSTRACT

The present invention is directed to a hard target incendiary projectile that includes a penetrator casing filled with an incendiary and having a rear opening sealed with a closure. When the projectile hits a target and penetrates, a fuze ignites the incendiary. Hot gasses from the burning incendiary increase pressure within the casing so that within milliseconds of the fuze firing, pressure within the casing ejects the closure out of the rear opening with a vigorous pressure pulse that expels burning fragments of incendiary into the interior of the target. The projectile can also carry additional payloads such as chemicals, radioactive materials, and electric/electronic devices that can be ejected from within the casing into the target. The projectile can also be configured so that pressure within the casing opens vents in the closure but does not eject the closure. As the incendiary combusts or reacts within the casing, hot reaction products are vented through the vents into the target. The incendiary can be a non-detonable insensitive solid rocket propellant that burns well at ambient pressure and that can be ignited with a standard fuze having an explosive booster. The casing can be a standard casing that is used in commercially available hard target, high explosive projectiles such as the BLU-109/B or BLU-109A/B currently in service with the U.S. Air Force and the U.S. Navy.

39 Claims, 20 Drawing Sheets

U.S. PATENT DOCUMENTS

| | | | |
|---|---|---|---|
| 3,893,814 | 7/1975 | McGhee | 29/1.21 |
| 3,902,400 | 9/1975 | Kincheloe et al. | 89/1.14 |
| 3,946,673 | 3/1976 | Hayes | 75/248 |
| 3,981,243 | 9/1976 | Doris, Jr. | 102/364 |
| 4,015,529 | 4/1977 | Knapp | 102/364 |
| 4,023,492 | 5/1977 | Kempton | 102/364 |
| 4,063,512 | 12/1977 | Davis | 102/476 |
| 4,112,846 | 9/1978 | Gilbert et al. | 102/364 |
| 4,318,343 | 3/1982 | King | 102/365 |
| 4,458,596 | 7/1984 | Armstrong | 102/389 |
| 4,648,324 | 3/1987 | McDermott | 102/518 |
| 4,836,108 | 6/1989 | Kegel et al. | 102/306 |
| 4,867,061 | 9/1989 | Stadler et al. | 102/307 |
| 4,876,964 | 10/1989 | Strandli | 102/499 |
| 4,932,326 | 6/1990 | Ladriere | 102/364 |
| 5,000,095 | 3/1991 | Reiger et al. | 102/489 |
| 5,074,214 | 12/1991 | Zeren | 102/293 |
| 5,097,766 | 3/1992 | Campoli et al. | 102/364 |
| 5,129,305 | 7/1992 | Reilly | 89/1.11 |
| 5,157,221 | 10/1992 | Rönn | 102/216 |
| 5,243,917 | 9/1993 | Komstadius | 102/489 |
| 5,259,317 | 11/1993 | Lips | 102/307 |
| 5,309,843 | 5/1994 | Rentzsch et al. | 102/476 |
| 5,394,804 | 3/1995 | Cauchetier | 102/476 |
| 5,415,105 | 5/1995 | Voss et al. | 102/476 |
| 5,423,264 | 6/1995 | Siegler et al. | 102/342 |
| 5,442,989 | 8/1995 | Anderson | 86/20.12 |
| 5,464,699 | 11/1995 | Baldi | 428/607 |
| 5,515,789 | 5/1996 | Brochand et al. | 104/184 |
| 5,561,261 | 10/1996 | Lindstädt et al. | 102/476 |
| 5,565,648 | 10/1996 | Lindstädt et al. | 102/478 |
| 5,594,197 | 1/1997 | Lindstadt et al. | 102/499 |
| 5,728,968 | 3/1998 | Buzzett et al. | 102/364 |
| 5,886,289 | 3/1999 | Nixon et al. | 102/490 |

HARD TARGET INCENDIARY PROJECTILE

BACKGROUND OF THE INVENTION

1. Field of the Invention

The invention relates generally to the field of air dropped munitions, and particularly to incendiary projectiles for destroying hard or soft targets that contain biological or chemical agents or are flammable.

2. State of the Art

Various devices and methods for delivering incendiary and/or high explosive materials to a target for piercing the target are known in the art. For example, U.S. Pat. No. 4,318,343 to King describes a dual mode incendiary bomblet designed to penetrate building roofs and ignite fires within buildings. The bomblet includes a steel or aluminum penetration point 12, a tubular body 11, an aft closure 13, and a dual mode incendiary package 14 located within the tubular body 11. The incendiary package 14 contains a jetting incendiary 19 and a slow burning incendiary 20. The jetting incendiary 19 is made, for example, from a combination of plaster of paris and aluminum powder, and provides an extremely hot jetting flame. The slow burning incendiary 20 is made, for example, of a thickened hydrocarbon such as napalm, and provides a cooler but longer burning flame than the jetting incendiary. These incendiaries require an external oxygen source such as air in order to burn.

In operation, the bomblet is dropped from an aircraft. Upon striking the roof, a contact fuze in the bomblet is activated and in turn activates a delay train. After passing through the roof, the bomblet comes to rest on a horizontal surface in the building. Upon completion of the delay in the delay train, the delay train detonates an ejection cartridge 15 located in the bomblet forward of the incendiary package 14. When the ejection cartridge 15 is detonated, gaseous products generated by the cartridge 15 build gas pressure within the bomblet until the gas pressure blows off the aft closure 13 and ejects the incendiary package 14 out of the housing. Flame from the ejection cartridge 15 ignites a flammable case surrounding the incendiary package 14 at the same time the incendiary package 14 is blown out of the housing. During ejection of the incendiary package, the burning case surrounding the incendiary package 14 ignites incendiary igniters 23, 24 which ignite the jetting incendiary 19 component of the incendiary package 14. Passages 21, 22 are provided in the jetting incendiary 19 to focus jets of flame and hot gasses. The burning jetting incendiary 19 ignites the slow burning incendiary 20. Flame jets from the jetting incendiary 19 pierce objects that have generally non-flammable coverings, such as steel desks or book cases, and the slow burning incendiary 20 ensures that contents of pierced objects, such as paper documents are ignited.

U.S. Pat. No. 3,797,391 to Cammarata, et al. discloses an incendiary bomblet that includes several shaped charges oriented in different directions to perforate hard structures and propel incendiary particles through the perforations.

U.S. Pats. No. 5,561,261, 5,565,648 and 5,594,197 to Lindstadt et al. describe a tandem warhead having a shaped charge at the front and a secondary, explosive projectile at the rear that is capable of surviving detonation of the shaped charge. Detonation of the shaped charge creates a channel in a target, and the secondary projectile travels down the channel before exploding.

U.S. Pat. No. 5,157,221 to Ronn discloses a projectile that has a forward oriented, shaped charge explosive and an adaptive fuze in a nose of the projectile. In operation the adaptive fuze determines whether the projectile has hit a hard or a soft target. If the projectile hits a soft target and not a hard target, then the fuze detonates the explosive after a delay. If the projectile hits a hard target, the fuze detonates the explosive immediately.

U.S. Pat. No. 5,259,317 to Lips discloses a shaped charge explosive that has a waveguide element 2.1, 2.2 made of an incendiary material. Making the waveguide element 2.1, 2.2 out of an incendiary material enhances a pyrophoric effect of the explosive on a target. Incendiary material 3.1, 3.2 can also be provided on an inside surface of the shaped charge.

U.S. Pat. No. 4,932,326 to Ladriere discloses a piercing projectile that includes a hard, cylindrical body 6, an auxiliary projectile 3, and a propulsive charge 4. The auxiliary projectile 3 is positioned within the cylindrical body 6 and in front of the propulsive charge 4. When the projectile hits a target, a fuze 17 in the nose of the projectile ignites the propulsive charge 4, which drives the auxiliary projectile 3 through the hollow center of the cylindrical body 6 toward the target. Cavities 13 can also be provided on an inside surface of the cylindrical body 6 and filled with an incendiary material, so that passage of the auxiliary projectile 3 and hot gasses from the propulsive charge 4 through the cylindrical body 6 ignite the incendiary material.

U.S. Pat. No. 4,648,324 to McDermott discloses a penetrating projectile that includes a shell body with a penetrating rod 24 within the shell body. An incendiary material 48 is located in the nose of the shell body in front of the penetrating rod 24. An annular ring 26 supports a head of the penetrating rod 24 within the shell body and acts as a sabot. Gas producing charges are located in the shell body immediately behind the sabot, and a high explosive charge 50 is located behind the gas producing charges. Long-burning incendiary material is located behind the gas producing charges in the rear of the shell body. When the projectile hits a target, the incendiary material 48 in the nose of the projectile and the gas producing charges behind the annular ring ignite. The gases produced by the charges behind the annular ring propel the annular ring and the penetrating rod 24 toward the target.

U.S. Pat. No. 5,309,843 to Rentzsch et al. discloses a warhead with a tandem charge. In particular, a forward-oriented, shaped charge explosive is located at the front of the warhead, and a secondary, fragmentation projectile is located behind the shaped charge. On impact with a target, the shaped charge detonates and creates a hole in the target. Momentum carries the secondary projectile through the hole and into the target, where a delayed fuze detonates the secondary projectile for maximum effect.

However, none of the conventional techniques and designs provide an improved hard target incendiary (IHTI) projectile that is relatively inexpensive, robust, and capable of penetrating hardened or soft targets such as underground or surface structures and/or concrete bunkers and immolating contents of the targets such as chemical and/or biological warfare agents without spreading unacceptable amounts of undestroyed contents outside the structures.

SUMMARY OF THE INVENTION

Exemplary embodiments of the invention overcome the challenges described above by providing an IHTI projectile that penetrates hard targets without functional damage to the projectile, generates an energetic pressure pulse that opens the projectile inside the target, and delivers a sustained pulse of heat energy within the target that destroys the contents of the target. The energetic pressure pulse can disrupt the target's contents, such as biological or chemical apparatus and storage containers, thus enhancing the sterilizing and cleansing effect of the sustained pulse of heat energy.

According to an embodiment of the invention, the IHTI projectile uses a nondetonating, ambient-pressure flame and heat producing material such as an incendiary material, and uses a standard hard target fuze with a conventional explosive booster as the igniter for the incendiary. In particular, an incendiary material is a material that burns or chemically reacts in the absence of exposure to air, i.e., in the absence of an air supply, to produce heat and a hot mixture of solid and gaseous chemical products. Hot gasses produced by the incendiary material as it reacts within the IHTI projectile, also produce pressure that opens the rear end of the IHTI projectile and ejects at least a portion of the incendiary material out of the projectile through the rear opening.

According to an embodiment of the invention, a hard target incendiary projectile that is compatible with existing military aircraft interfaces, and has the same dimensions, weight and ballistic performance as existing munitions, can be easily manufactured using conventional hard target projectile casings and fuze systems. This use of readily available components and systems to manufacture, handle and use the IHTI projectile dramatically reduces research, development, manufacturing and operational costs and enhances availability of the IHTI projectile for service.

According to an embodiment of the invention, incendiaries used within the IHTI projectile include commercially available, non-detonable rocket propellants as well as other materials that combust or react in the absence of contract with air that are well known in the rocket propulsion, flare and incendiary arts. According to another embodiment of the invention, the IHTI projectile can be designed to eject a specified portion of ignited but unburned incendiary material from the projectile casing when the pressure pulse opens the projectile, or can be designed so that the incendiary burns within the projectile and the hot reaction products from the burning incendiary are vented from the projectile into the target.

BRIEF DESCRIPTION OF THE DRAWINGS

Other objects and advantages of the present invention will become apparent to those skilled in the art from the following detailed description of preferred embodiments, when read in conjunction with the accompanying drawings wherein like elements have been designated with like reference numerals and wherein.

DETAILED DESCRIPTION OF THE PREFERRED EMBODIMENTS

In time or war or armed conflict it may be necessary to use ballistic munitions to effectively destroy targets that contain, for example, biological or chemical warfare agents or flammable materials. Mission requirements for such a task require that the munition survive a high angle of impact with the target and remain functional, and also that the munition a) generate and distribute sufficient heat and/or chemical residue to neutralize biological or chemical agents within the target, without dispersing significant amounts of un-neutralized portions of the agent outside the target, and b) ignite flammable material within the target. For example, there may be rockets or other devices in the target that will combust in the absence of an air supply, once ignited by the IHTI projectile. The target may also have an air supply that will support combustion of flammable materials within the target once the flammable materials are ignited by the IHTI projectile. Usefulness of an IHTI projectile capable of satisfying these mission requirements can be enhanced if it is constructed using components from standard hard target, high explosive projectiles such as the BLU-109/B already in service with U.S. military armed forces. These common components can include, for example, penetrator casings and standard fuzes containing explosive boosters. Usefulness of the IHTI projectile can be further enhanced if it has the same weight, balance and electrical and mechanical interfaces as other munitions already in service, such as the BLU-109/B, so that it can be stored, handled and delivered to a target using the same systems and procedures used for the other munitions.

Figure 1A:
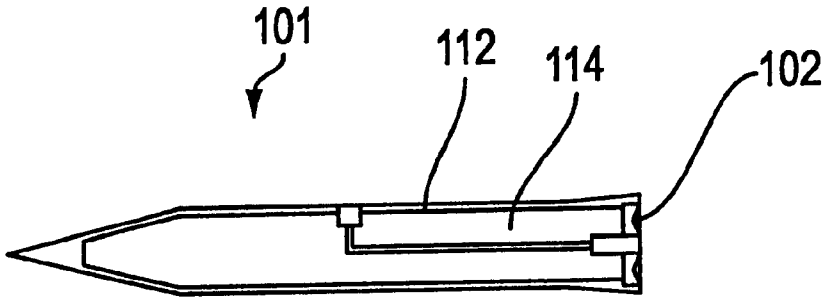
FIG. 1A shows an IHTI projectile according to an embodiment of the invention.
Figure 1B:
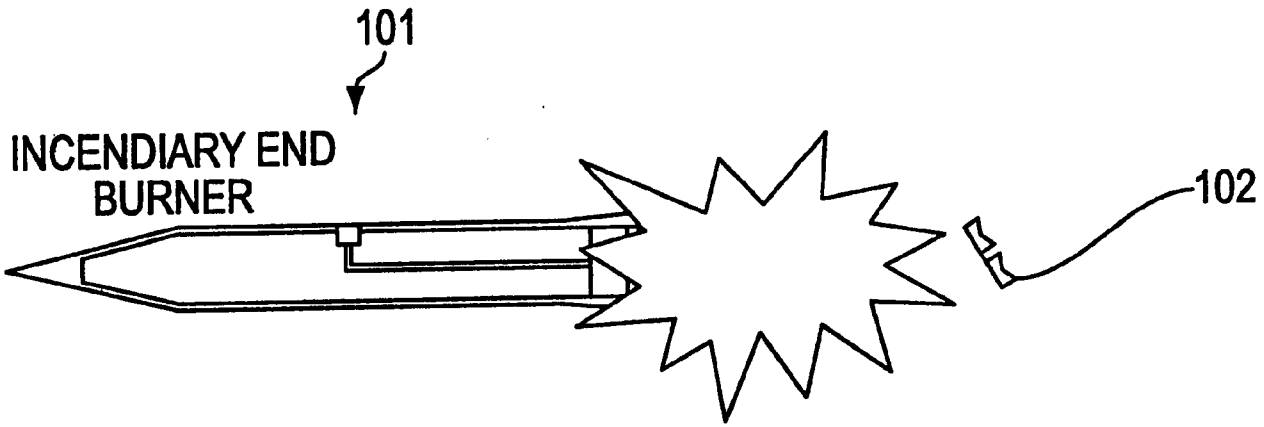
FIG. 1B shows a status of the IHTI projectile of FIG. 2A shortly after hot gasses from burning incendiary within the IHTI projectile have opened a rear end of the IHTI projectile.

FIG. 1A shows a basic embodiment of an IHTI projectile 101 in accordance with the invention, with an incendiary 114 sealed within a penetrator casing 112 by a cap or aft closure 102 at the back of the casing 112. As shown in FIG. 1B, when the incendiary is ignited, gas pressure builds inside the casing until it ejects the aft closure 102 from the back of the casing, releasing ignited incendiary material. When the IHTI projectile 101 is used against a hardened bunker, several scenarios can occur.

Figure 2B:
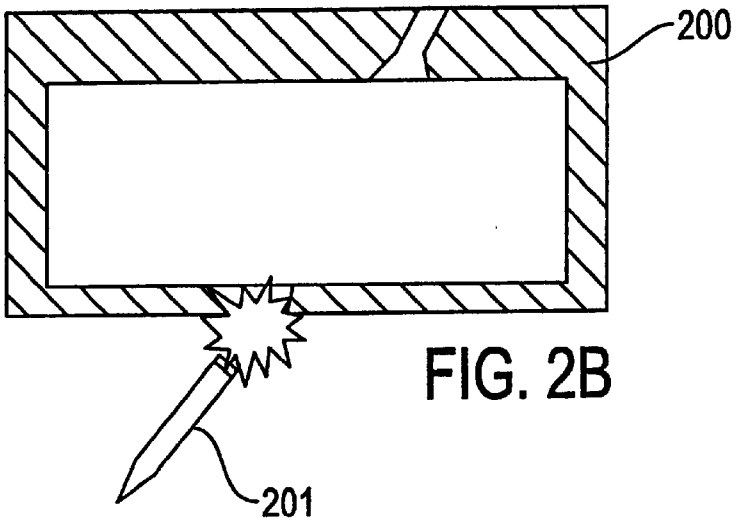
FIGS. 2A–2C show different scenarios of an IHTI projectile according to the invention hitting a target.
Figure 2A:
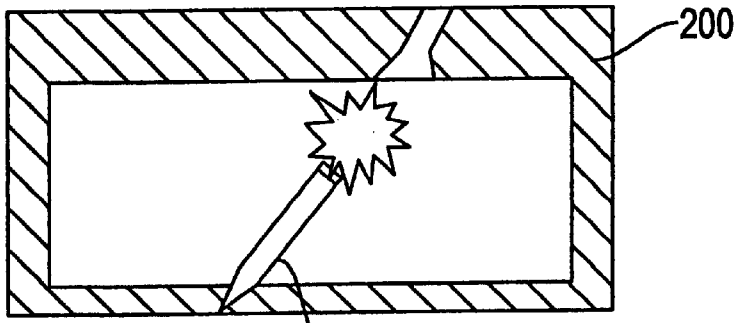
Figure 2C:
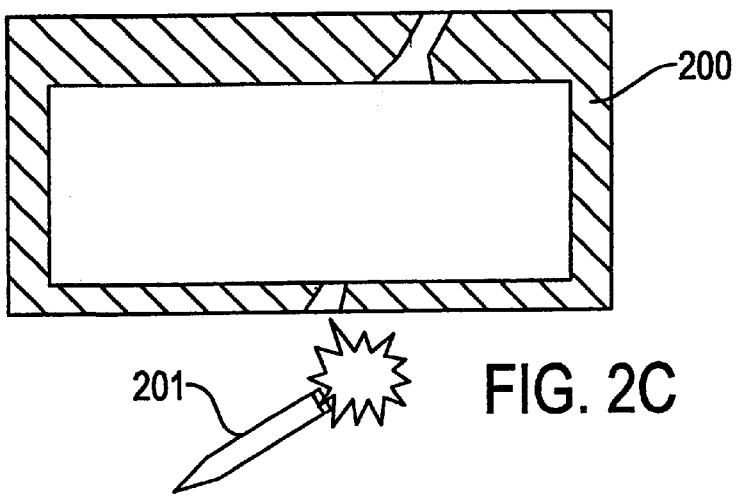

FIG. 2A shows a first scenario, where the IHTI projectile 201 has penetrated an underground concrete bunker 200 and is ejecting burning incendiary within the bunker 200. In FIG. 2B, the projectile 201 has passed through the bunker 200 and into earth below, and the projectile 201 is ejecting burning incendiary and/or hot gasses from incendiary burning within the projectile 201, up through the earthen tunnel created by the projectile's impact into the bunker 200. In FIG. 2C, the projectile 201 has passed through the bunker 200 into the earth beneath, and has "J-hooked" so that the rear of the projectile 201 is no longer aligned with the tunnel created by the projectile 201. In this situation, the pressure pulse of the projectile 201 preferably buckles the floor of the bunker 200, and/or injects burning incendiary material back into the bunker 200 even though the projectile 201 is no longer aligned with the tunnel.

The rearward ejection of combustion products and/or burning incendiary provides a number of additional advantages. For example, aft-ejection simplifies design of the projectile. In addition, when a lightly protected structure is attacked and the projectile fuze ignites the incendiary before the projectile has passed completely through the structure, the incendiary is dispersed within the structure, instead of being buried below the structure.

Figure 3:
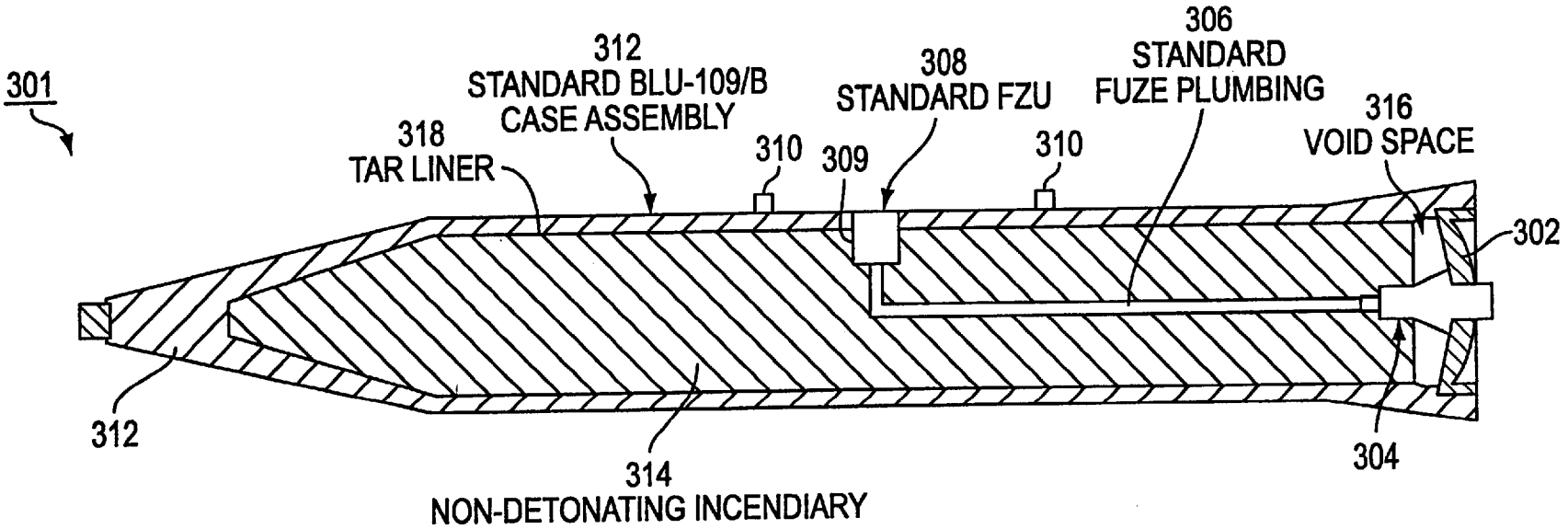
FIG. 3 shows an IHTI projectile according to another embodiment of the invention.

FIG. 3 shows an IHTI projectile in greater detail. The penetrator casing 312 having a tar liner 318 is filled with an incendiary 314. The incendiary 314 can be either rigid or resilient. The incendiary 314 is preferably a solid, non-detonable incendiary that ignites and burns well at ambient pressure with or without the presence of air. Rocket propellants and flare compositions having these characteristics are well-known. For example, the incendiary can be made of a substance commonly used as a solid rocket propellant in the solid fuel rocket booster NASA uses to put the Space Shuttle into orbit. This propellant is composed of a rubber polymer compound, aluminum powder and ammonium perchlorate powder. This mixture can be cast into the casing 312, and then baked for several days until it is cured. The aft end of the casing 312 is sealed with an aft closure 302. An optional void space 316 is provided between the inner surface of the aft closure 302 and the incendiary 314, and a fuze 304 is provided in the void space 316 to ignite the incendiary 314. The incendiary 314 is preferably either non-detonable or insensitive (difficult to detonate), so that fuzes containing an explosive booster can be used to ignite the incendiary 314 without detonating it. Detonable explosives can also be used as an incendiary, if they are ignited so that they burn instead of detonating. In such an instance, a fuze containing a deflagrating booster instead of an explosive booster would be preferable.

A hard target casing with a high explosive filler that can either be detonated or ignited, such as AFX-757 for example, can be used as a dual purpose projectile that can be easily configured to be either a hard target, high explosive projectile or a hard target, incendiary projectile by swapping in a fuze containing either an explosive booster or a deflagrating booster. Such a dual purpose projectile can act without change of the aft closure design to function in either the incendiary or detonation mode.

The casing 312 can be, for example, the same casing used for the BLU-109/B hard target, high explosive bomb commonly used by U.S. military attack aircraft. A BLU-109/B bomb weighs about 2,000 pounds. The penetrator casing assembly, including various metal attachments and the aft closure of a BLU-109/B weighs about 1,500 pounds, is about 95 inches long with a 14.5 inch outer diameter and with a 16 inch outer diameter flare at the very rear and a 12.5 inch inner diameter from the aft end to near the front, tapering to a smaller diameter at the front,. Thus, the payload of the BLU-109/B weighs between 500 and 600 pounds, and can be a high explosive, an incendiary or other material. The casing 312 is fitted with attachment fittings 310 for securing the projectile to an airplane, and has an FZU well or charging well 309 for receiving a standard electric power generator 308, also known as an "FZU". The FZU 308 provides electrical power to the fuze 304 when the projectile is dropped on a target, and is connected to the fuze 304 by wiring through a standard fuze plumbing conduit arrangement 306.

When a standard casing like that of the BLU-109/B is used and filled with an incendiary so that the IHTI projectile 301 has the same dimensions and weight as the BLU-109/B, the IHTI projectile 301 can be handled, transported, stored and loaded onto combat aircraft using the same equipment and procedures as for the BLU-109/B. Since the same FZU, fuze plumbing and fuze are also used, no changes to the weapons control system of the aircraft are necessary. In addition, since the dimensions and mass of the IHTI projectile are the same, the ballistic performance of the IHTI projectile will also be the same. This principle applies when the IHTI projectile has the same dimensions, mass, etc. of any other projectile in military service. Other standard warheads can be used, and can be appropriately shrouded and weighted to emulate the shape, weight and balance of standard weapons such as the BLU-109/B, the BLU-116/B, the BLU-113/B, or the MK-84. Thus, the IHTI projectile can be effectively used without requiring new or additional equipment and skills.

The burn duration of the incendiary 314 can be specified by design, and is typically between about 30 seconds and about 10 minutes. A shorter burn time generally means that the incendiary burns more rapidly and can thus generate higher temperatures and/or pressures.

The ejection of incendiary or other payload from the IHTI projectile 301 within the target is important, because it must be vigorous enough to disperse the reactive payloads within the target so that the target contents are heated or chemically treated sufficiently to destroy the target contents. However, the pressure blow must not be so vigorous as to explode the target and disperse target contents without neutralizing them sufficiently. In other words, collateral damage must be minimal, especially when the target contents are biological or chemical agents such as anthrax or nerve gas that can be lethal when dispersed into an environment surrounding the target and inhabited by people.

Design of the IHTI projectile can be adjusted to tailor performance of the IHTI projectile to an intended type of target. For example, the energy of the pressure blow of the IHTI projectile 301 can be selected by altering various design parameters. The aft closure 302 can be designed to release when specified pressure levels within the projectile 301 are reached, thus controlling the force of the pressure blow. The energy of the pressure blow can be increased or decreased by increasing or decreasing the strength of the casing 312 and the aft closure 302. Increasing the void space 316 will also enhance the violence of the pressure blow, as will igniting the incendiary 314 at several points simultaneously. Igniting the incendiary 314 at several points simultaneously increases the effective burn area of the incendiary 314 which results in a more energetic development of pressure. Burn area of the incendiary, or surface area of the incendiary 314 available to burn, can also be increased to increase the effective burn rate of the incendiary 314 and thus the rate of initial pressure rise as well as the maximum pressure. This can be done, for example, by forming perforations or ports in the incendiary 314 during a manufacturing process, so that the perforations radiate or extend from an initial ignition point.

On the other hand, weakening the aft closure 302 or the connection that fastens the aft closure 302 to the casing 312 will moderate the vigor of the pressure blow.

Adhering a resilient incendiary 314 to the casing 312 can reduce fracturing of the incendiary 314 upon target impact, and cause more of the incendiary 314 to burn within the casing 312 as well as decrease the energy of the pressure blow. The number and size of the fragments determines a burn surface area a burn pressure and thus an overall burn rate and burn duration. The resilience of the incendiary helps prevent incendiary fragments expelled from the casing 312 from breaking into smaller pieces if they collide with objects within the target, and thus can be used to help maintain a specified burn duration.

Generally, the incendiary can be configured to ignite and then eject from the casing in burning fragments, or can be configured to remain in the casing while burning so that only hot combustion gases exit the casing. The incendiary can also be configured so that some of the incendiary burns within the casing and some without, in a desired proportion. The incendiary can also be bonded to the casing, partially bonded to the casing, or not bonded to the casing.

The aft closure 302 can be fastened to the casing 312 in different ways with a known, specified strength so that it will break when pressure inside the casing 312 exceeds a specified limit.

The incendiary 314 can have solid grains or ported (hollow) grains, where grains are individual bodies of incendiary. The incendiary 314 can be formed in a body having a grain structure, an amorphous structure, or other suitable structure. An incendiary body can also be shaped to have ports, grooves, hollows, cracks, fissures, or other geometric features, as shown for example in FIGS. 5B, 6B and 13A–13D. The incendiary 314 can also be designed or specified to leave a chemical residue within the target that endures and breaks down, neutralizes or sterilizes substances within the target such as chemical or biological agents. For example, the chemical residue can be an acid or a base capable of destroying or damaging machinery as well as biological and chemical agents.

The incendiary igniter is preferably a fast acting one such that ignition and/or dispense of the incendiary and other contained subpayloads can be accomplished at knowledgeable positions inside the target even though the projectile may be traveling at a high speed within the target. The incendiary igniter can be a standard fuze commonly used with hard target, high explosive projectiles such as the BLU-109/B having an explosive booster fabricated from PBXN7, PBXN5, or Tetryl. For example, the FMU-143E/B and FMU-143A/B fuzes can be used, as well as Joint Programmable Fuzes (JPF) and Hard Target Smart Fuzes (HTSF) originally developed by Motorola can also be used. The incendiary material can be ignited at the rear of the projectile, the front of the projectile, or at any other location, and an igniter, as differentiated from a fuze that initiates the igniter, can be located on or within the incendiary.

When attacking soft targets instead of hard targets, ejection of the incendiary charge inside the target structure is advantageous, since the penetrating projectile may pass through the structure and beyond it. Alternatively, an effective projectile can be constructed by substituting a soft target, general purpose bomb case such as that of the MK-84 for the BLU-109/B case in the projectile described above. Otherwise, the foregoing principles apply to a soft target incendiary projectile as well as to a hard target penetrator IHTI projectile.

Figure 20:
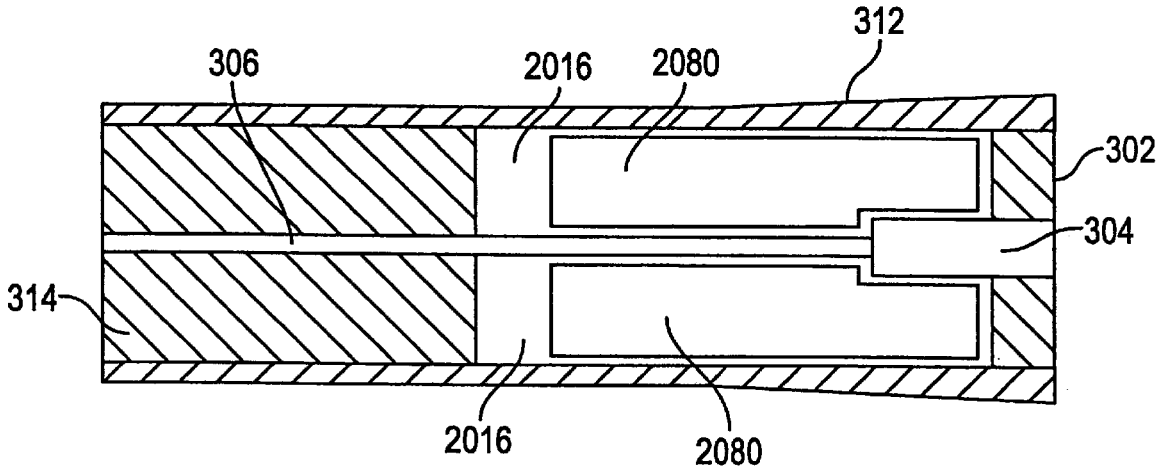
FIG. 20 shows additional payloads that can be loaded with an incendiary in an IHTI projectile according to another embodiment of the invention.

Additional cargos such as chemicals, radioactive materials or devices, electric/electronic devices such as high power microwave pulse generators, and explosive submunitions, e.g., fragmentation charges, can accompany the incendiary within the projectile. The additional cargo can be ejected or expelled from the projectile casing before, with or after the incendiary, and can be activated or dispersed within the target. The fragmentation charges, for example, can be ejected before, with or after the incendiary, in order to damage, perforate and disrupt items within the target such as storage vessels or chemical reactors, and maximize the total effect of the incendiary and any additional cargo(s) on their contents. The fragmentation charges can be configured with delay mechanisms so that they detonate upon expiration of a predetermined time interval that begins with ignition of the incendiary within the projectile, expulsion of the fragmentation charges from the projectile, or other appropriate starting time. In addition, the fragmentation charges carried in the projectile can have different time delays, so that they detonate at different times. FIG. 20 shows an aft end of an IHTI projectile, with a cargo or additional payload bay 2080 located near a fuze 304 and having a void space, or ullage 2016.

Figure 4:
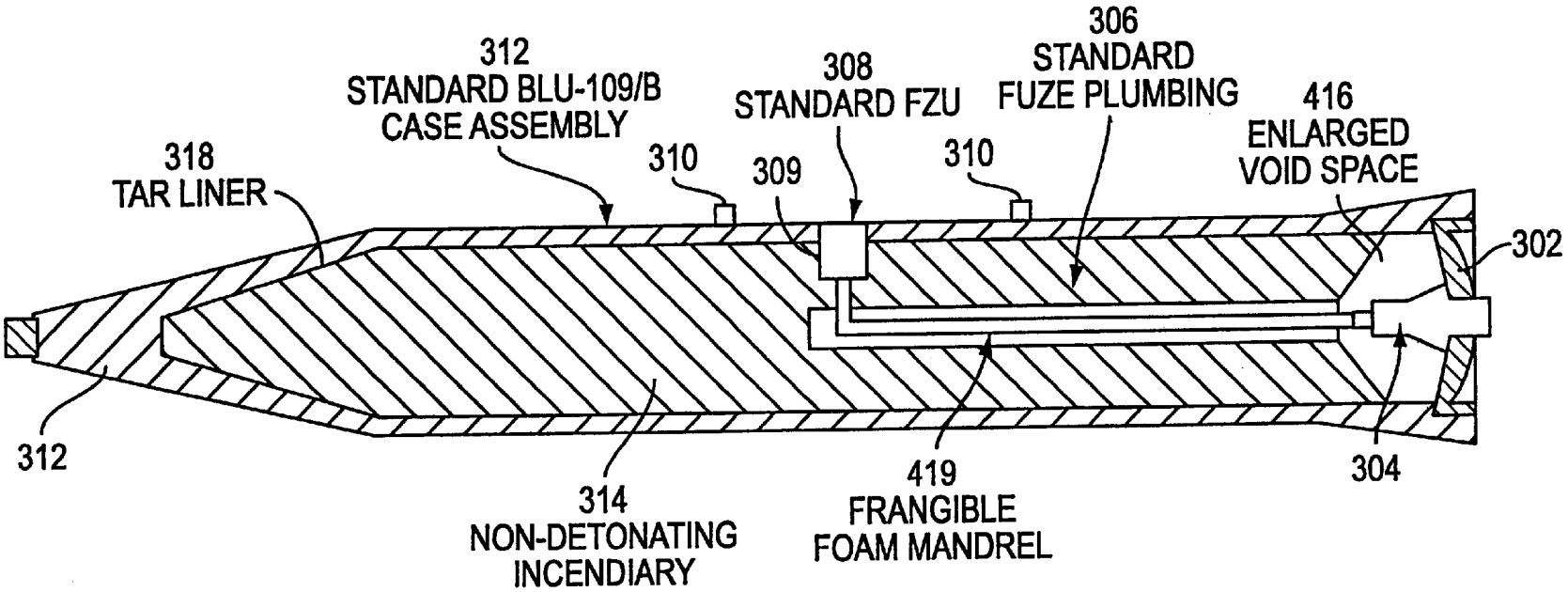
FIG. 4 shows an IHTI projectile according to another embodiment of the invention.

FIG. 4 shows an IHTI projectile that is similar to that shown in FIG. 3, but differs in that the standard fuze plumbing includes a frangible foam mandrel 419, and an enlarged void space 416. The frangible mandrel 419 will collapse upon ignition causing the available port volume to be increased, thus enhancing the pressure blow. The incendiary in this projectile will burn for about 0.5 to 2 minutes, and part or most of the incendiary material will be ejected from the casing 312. This projectile performs differently from the IHTI projectile shown in FIG. 3, in that it has a softer ignition, the pressure increases more slowly at ignition, and extreme Kn at a midpoint of the incendiary 314 is eliminated. Kn is defined as a ratio of burn surface to vent area. For example, the ratio of an area over which propellant is burning to throat area of a nozzle through which hot reaction products such as combustion gasses exit.

Figures 5A, 5B, 5C:
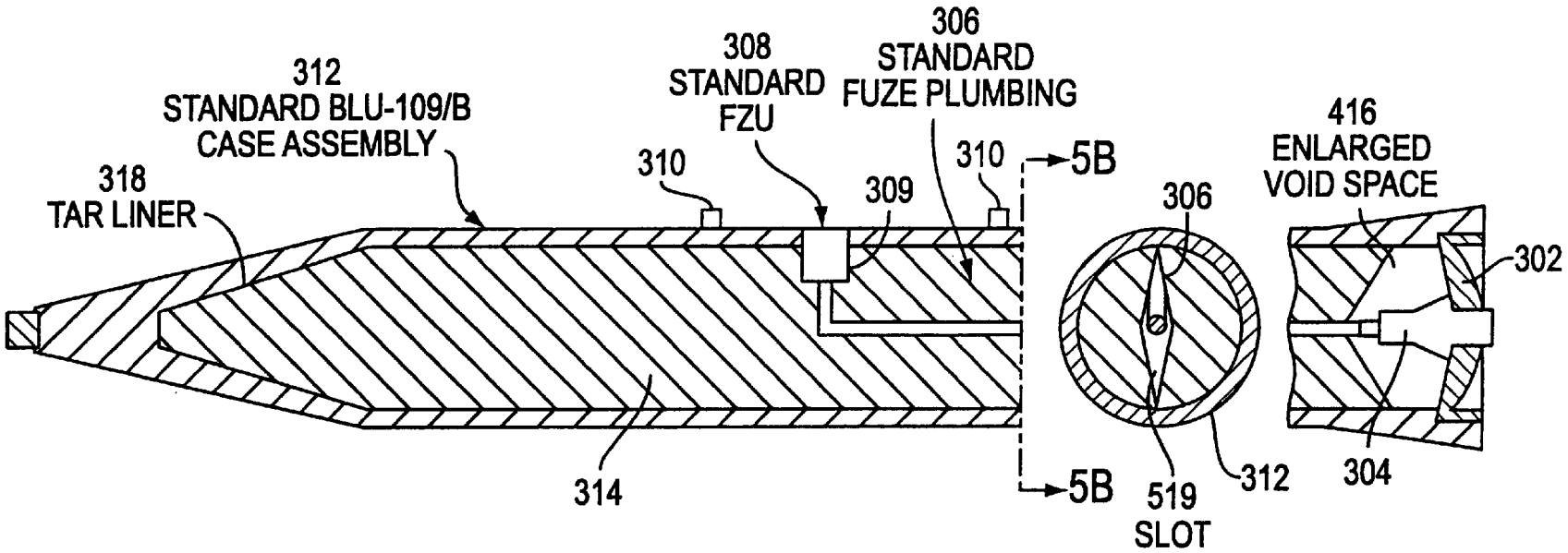
FIGS. 5A–5C show an IHTI projectile according to another embodiment of the invention.

FIGS. 5A and 5C show fore and aft portions of an IHTI projectile that is similar to that shown in FIG. 4. FIG. 5B is a cross-sectional view of the IHTI projectile along the line 5B—5B of FIG. 5A, and shows a in the incendiary 314 along the standard fuze plumbing 306 that is filled with a foam mandrel. This IHTI projectile functions differently from the IHTI projectile shown in FIG. 4, in that the burn duration is more consistent. Burn duration is on the order of 0.5 to 1 minute, and part or most of the incendiary 314 will be ejected from the casing 312. The IHTI projectile shown in FIGS. 5A–5C may require an ignition booster such as ITLX or BKNO3 in addition to an explosive booster.

Figures 6A, 6B, 6C:
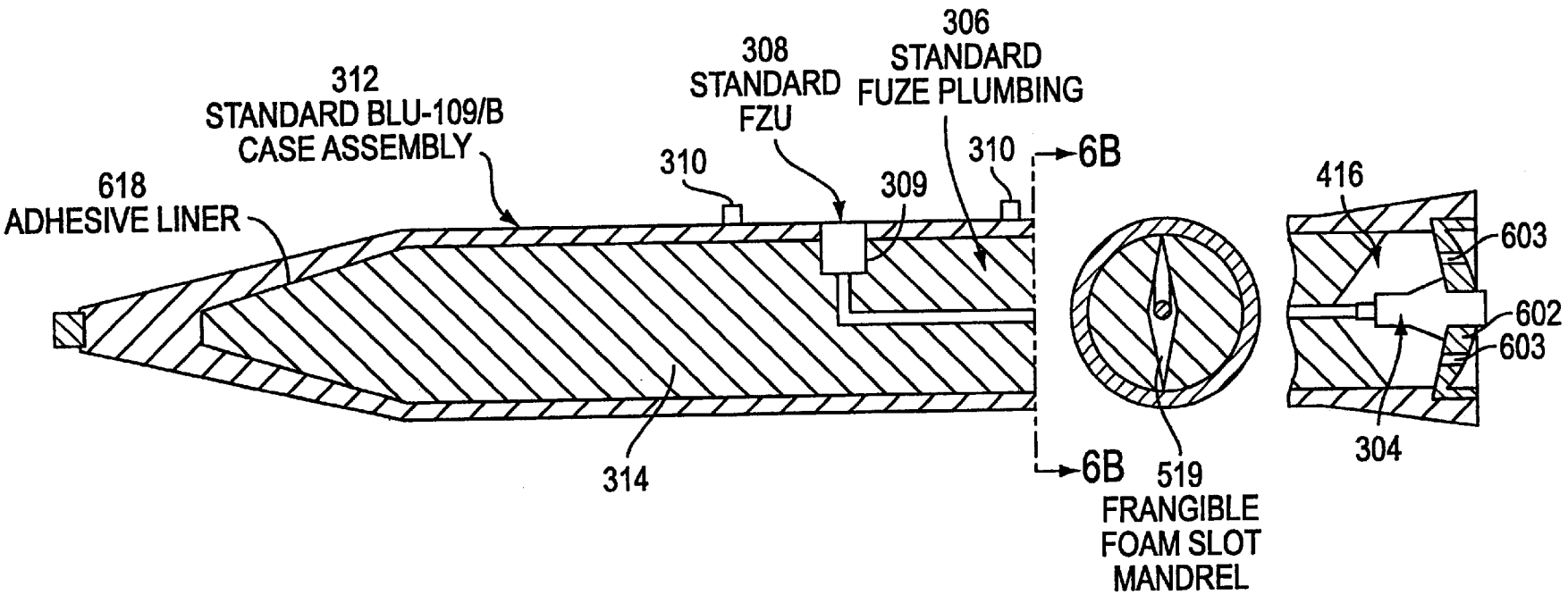
FIGS. 6A–6C show an IHTI projectile according to another embodiment of the invention.

The IHTI projectile shown in FIGS. 6A–6C differs from the IHTI projectile shown in FIGS. 5A–5C, in that an adhesive liner 618 is used instead of a tar liner and fastens the outer surface of the incendiary 314 to the interior surface of the casing 312. In addition, the aft closure 602 is provided with vents 603. The vents 603 suppress a pressure blow, so that the aft closure 602 stays attached to the casing 312 as the incendiary 314 burns, so that hot combustion gasses exit the casing 312 primarily through the vents 603. Additional vent area will open through the fuze assembly as hot gasses destroy the fuze body and eject it. The burn duration of the IHTI projectile is controlled by design to last between about 30 seconds and about 1 minute. FIG. 6B is a cross-sectional view along the line 6B—6B of FIG. 6A.

Figure 7:
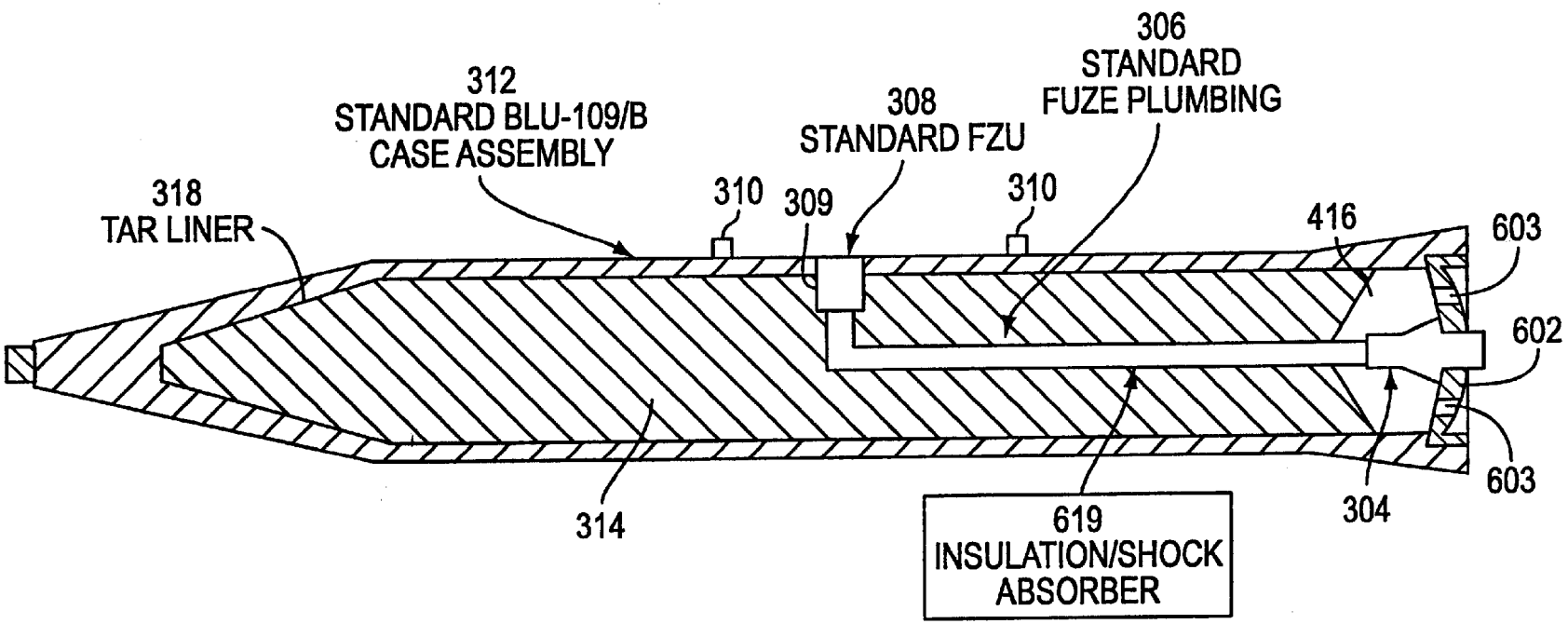
FIG. 7 shows an IHTI projectile according to another embodiment of the invention.

FIG. 7 shows another embodiment of an IHTI projectile that is similar to that shown in FIGS. 6A–6C, except that it has a tar liner 318 and the standard fuze plumbing 306 includes an insulator and shock absorber 619. The burn duration of this projectile is on the order of 10–12 minutes, and very small amounts of the incendiary are ejected through the vents 603. An ignition booster may be required for reliable operation.

Figure 8:
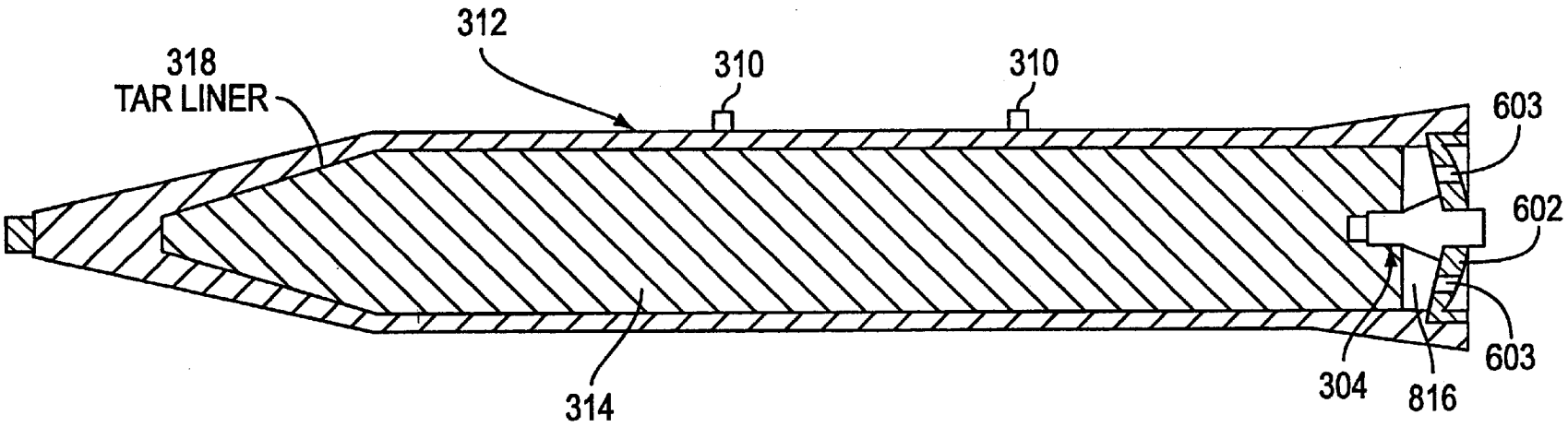
FIG. 8 shows an IHTI projectile according to another embodiment of the invention.

FIG. 8 shows another embodiment of an IHTI projectile, which is similar to that shown in FIG. 7 but has a void space 816 and no FZU or standard fuze plumbing. Burn duration is on the order of 10–12 minutes, and an ignition booster may be required for reliable operation.

Figure 9:
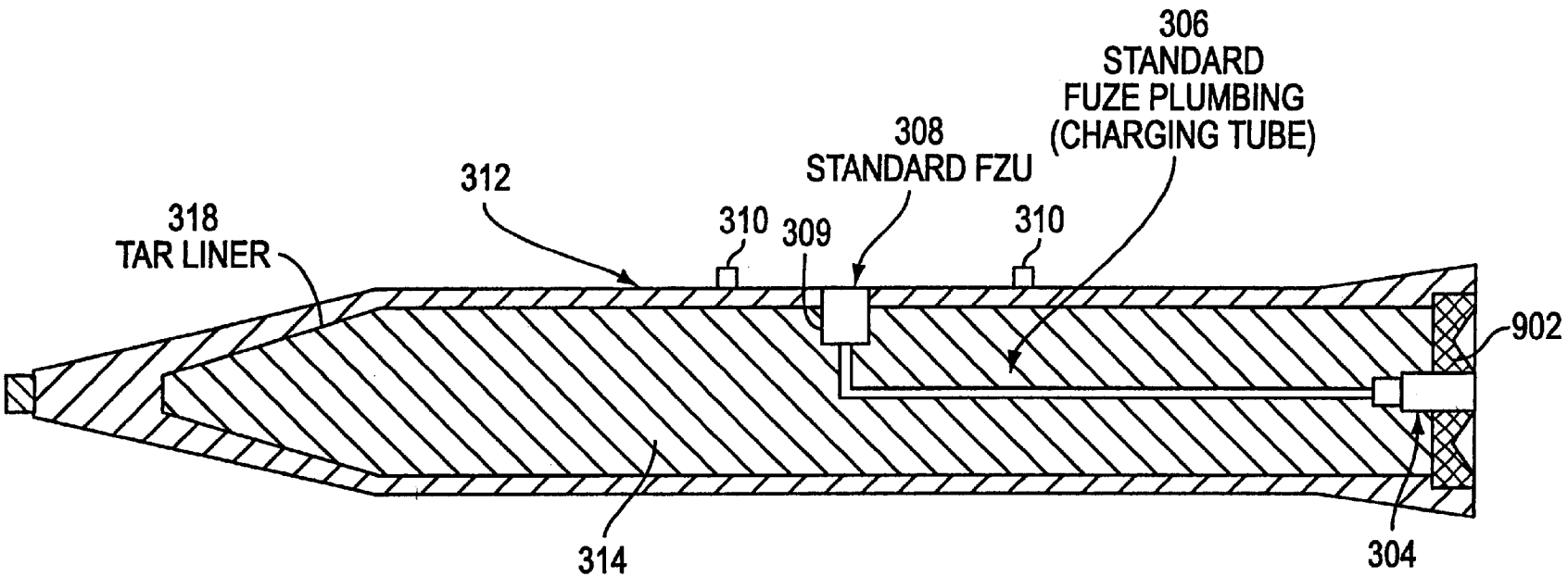
FIG. 9 shows an IHTI projectile according to another embodiment of the invention.
Figure 10:
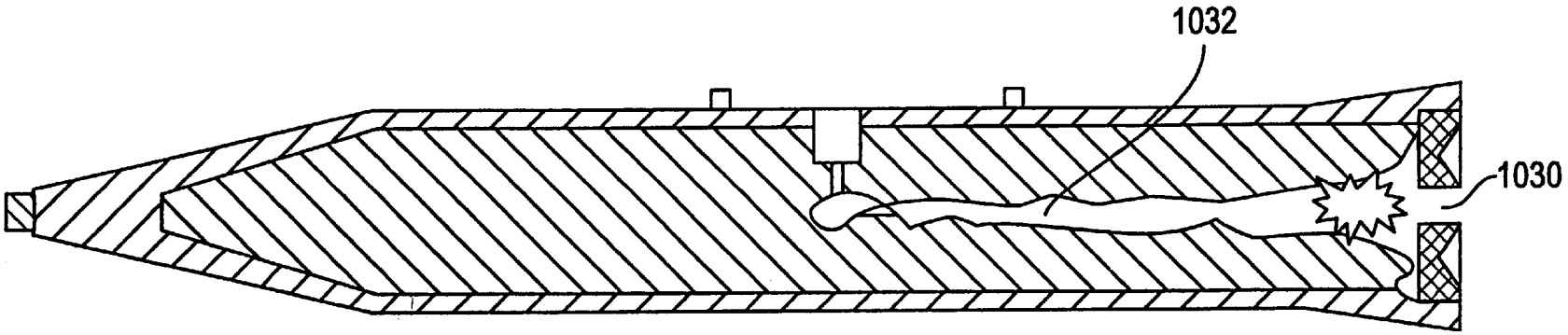
FIG. 10 shows ignition of the IHTI projectile shown in FIG. 9.
Figure 11:
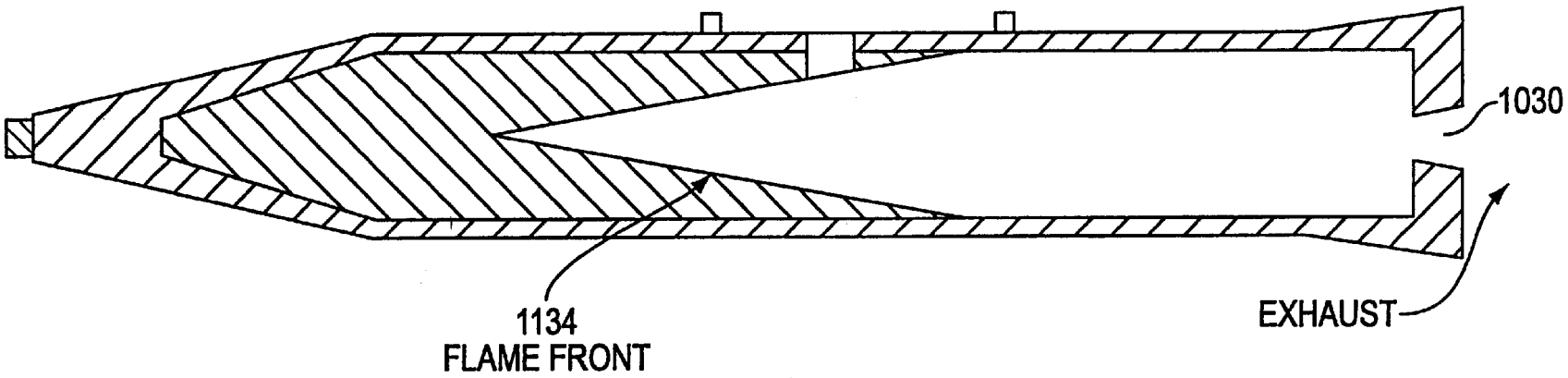
FIG. 11 shows a flame front within the IHTI projectile of FIG. 9, after ignition.

FIG. 9 shows an IHTI projectile that is similar to that shown in FIG. 3. As shown in FIG. 10, when the fuze 304 is fired, it sends hot gasses through a charging tube in the standard fuze plumbing 306 toward the front of the projectile. The charging tube ruptures, exposing incendiary along the standard fuze plumbing 306 to the hot gasses, and igniting the incendiary along the channel 1032. Firing of the fuze 304 also opens an aperture 1030 in the aft closure 902. As shown in FIG. 11, as a flame front 1134 propagates through the incendiary, combustion products exit the casing 312 through the aperture 1030.

Figure 12:
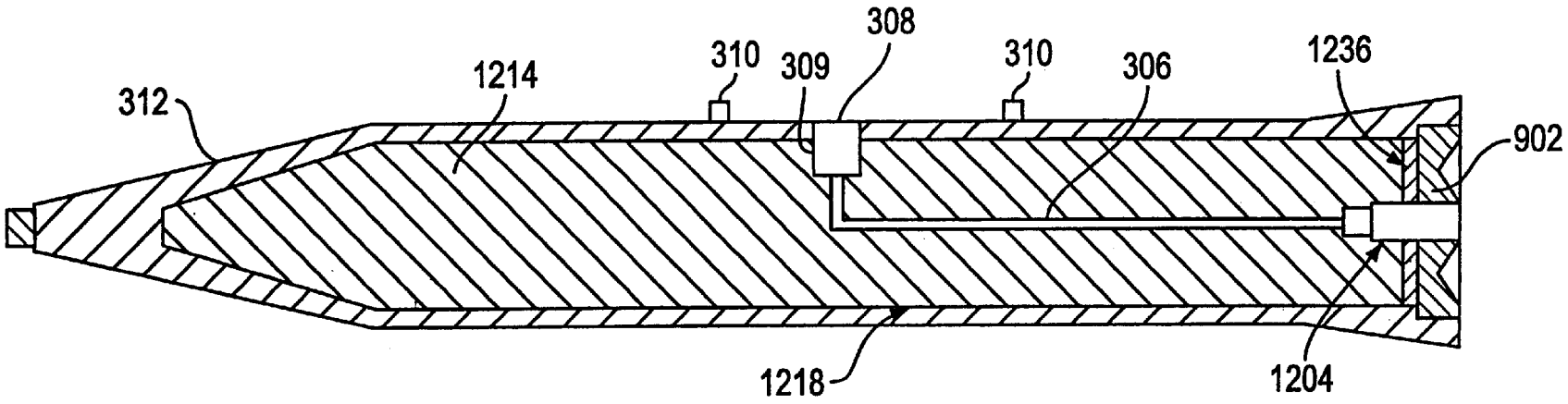
FIG. 12 shows an IHTI projectile according to another embodiment of the invention.

FIG. 12 shows an IHTI projectile that is similar to that shown in FIG. 9, but with an insulator 1236 on an interior surface of the aft closure 902, to reduce erosion of the aft closure 902 and enlargement of an aperture in the aft closure 902 as the incendiary 1214 burns and hot material exits the casing through the aperture. A fuze 1204 having a booster tailored for controlled ignition of the incendiary 1214 is also provided. The projectile also includes a tar liner 1218. The incendiary 1214 is an ambient burning incendiary formulation produced by Thiokol, among others, and the exterior of the incendiary 1214 facing the interior of the casing 312 is partially unbonded.

Figures 13A, 13B, 13C:
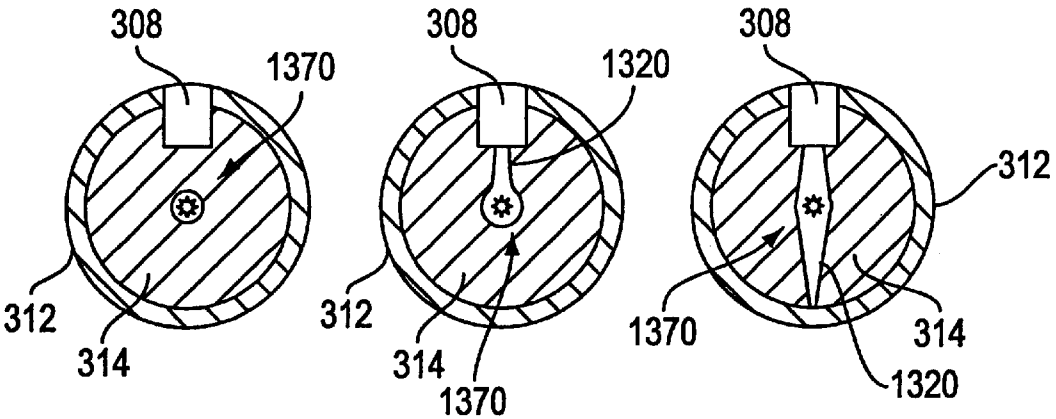
FIGS. 13A–13D shows a propellant structure of an IHTI projectile according to another embodiment of the invention.
Figure 13D:
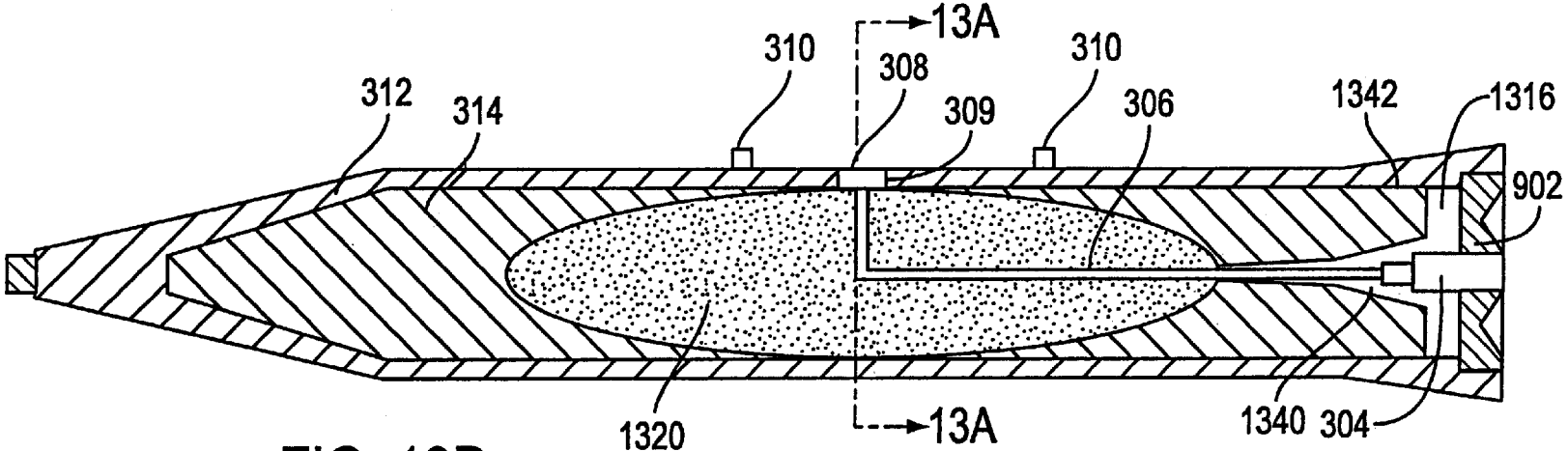

FIGS. 13A–D show how cracks or fissures can develop in the incendiary 314 when the incendiary 314 is cooled after curing in the casing 312. Formation of the fissures depends on the amount of cooling allowed. FIGS. 13A–C are cross-sectional views along the line 13A—13A of FIG. 13D. The incendiary 314 unbonds from the standard fuze plumbing 306 in a region 1370, and one or two radial cracks can originate near the middle of the incendiary material and then propagate to form the cracks or fissures 1320, as shown in FIGS. 13A–D. The short, vertical section of the faze plumbing 306 that connects directly to the FZU 308 serves to localize and orient the cracking. Debonding space also occurs near the fuze 304, creating a channel 1340 that connects the ullage or void space 1316 with a locus of the radial fissures 1320 and a space 1342 between the incendiary 314 and the case 312. These cracks and separations in the incendiary 314 enhance the burn area and therefore cause faster development of pressure in the bomb when the fuze 304 is operated.

Figure 14:
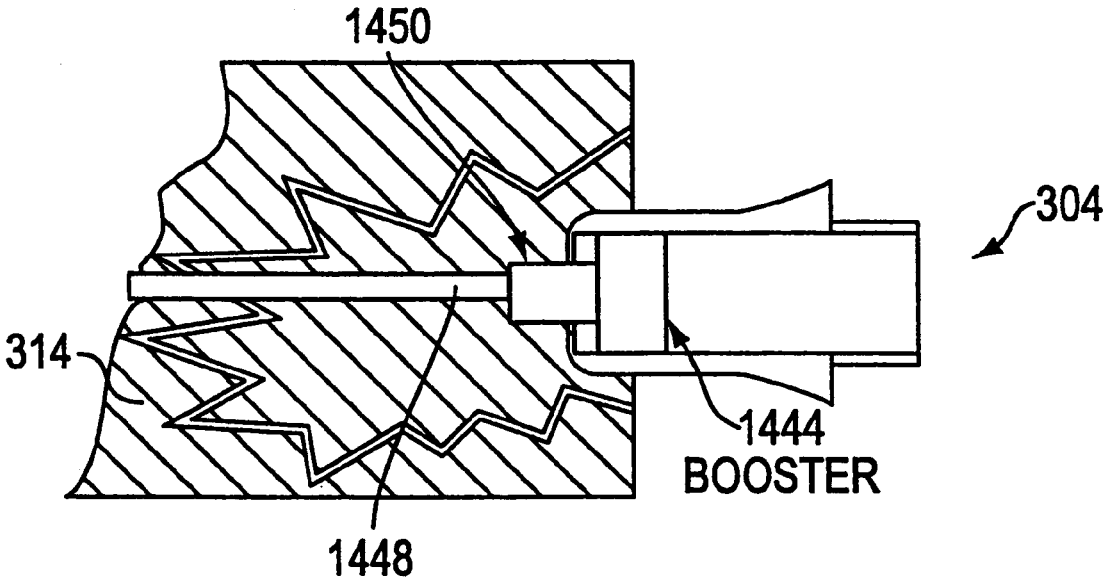
FIG. 14 shows a status of the IHTI projectile of FIG. 9 when an explosive booster in the fuze first detonates.

FIG. 14 shows what happens when the fuze 304 is fired in the IHTI projectile shown in FIGS. 13A–D. An explosive booster 1444 in the fuze 304 detonates, and drives an end coupling 1450 of the fuze 304 forward. The coupling 1450 crumples the charging tube 1448 of the standard fuze plumbing, and hot fuze flyer plate and fuze liner fragments radiate into the incendiary. Hot explosive gases exit forward, along and around the charging tube and into the fractured incendiary.

Figure 15:
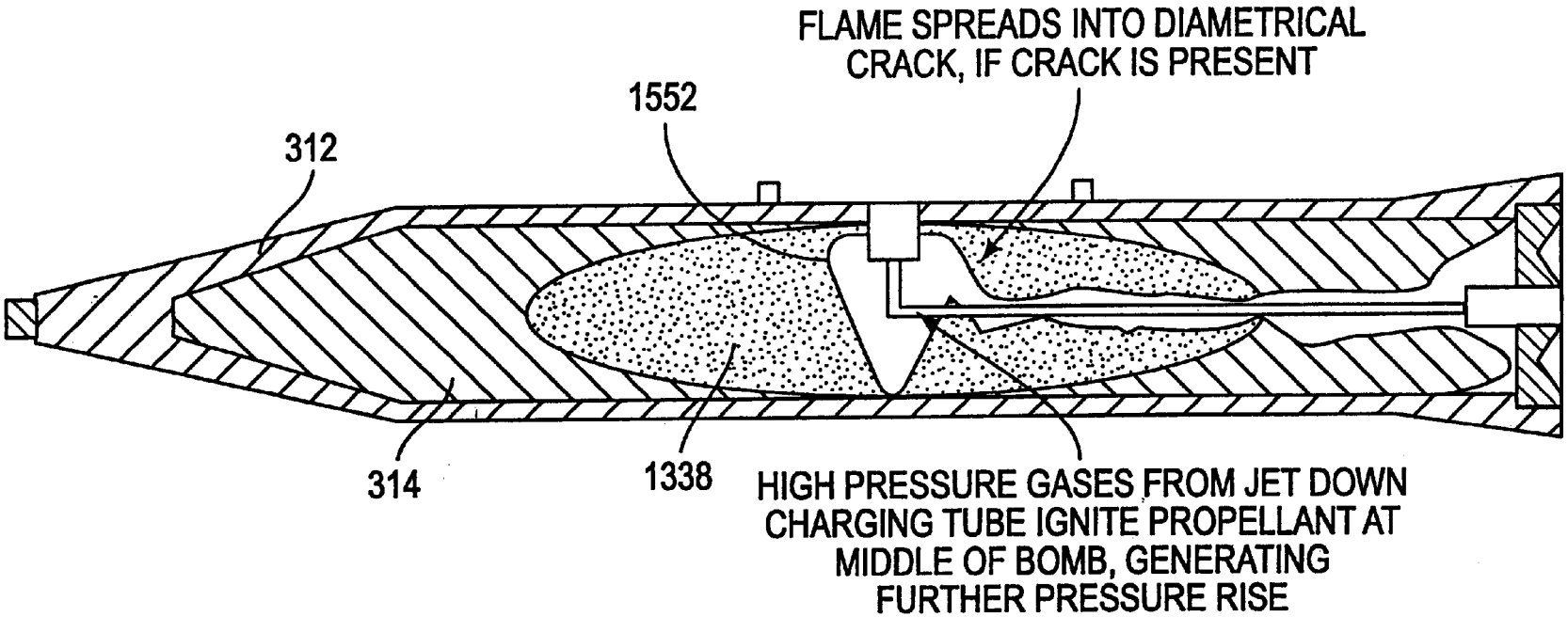
FIG. 15 shows a status of the IHTI projectile of FIG. 9 shortly after detonation of an explosive booster in the fuze.

As shown in FIG. 15, high pressure gases from the fuze jet forward down the charging tube and ignite incendiary at the middle of the IHTI projectile, and the flame front 1552 travels rapidly along the cracks 1338, if any, in the incendiary as gas pressure within the casing rises quickly.

Figure 16:
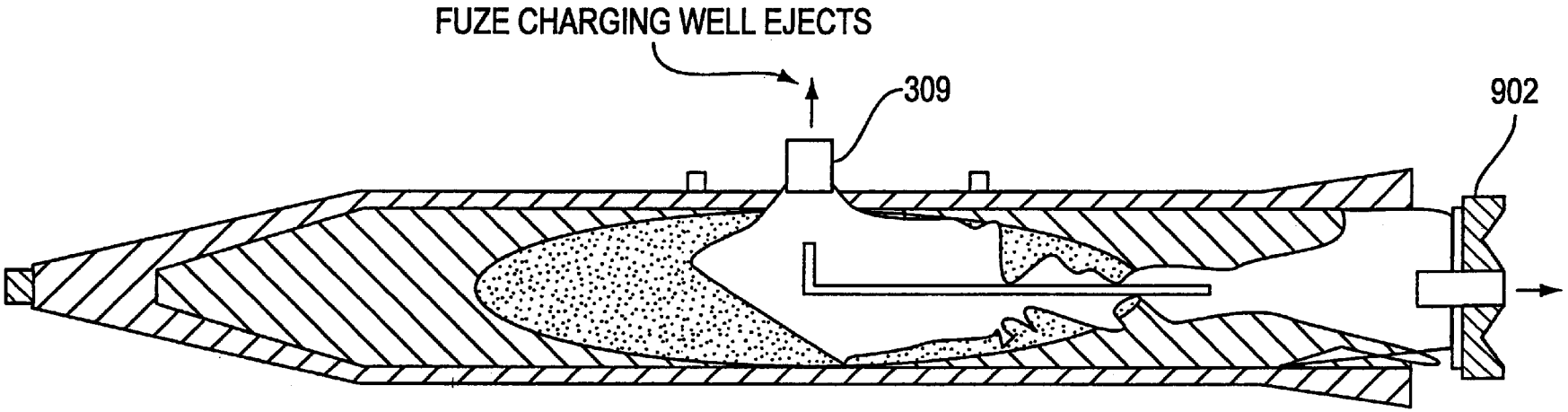
FIG. 16 shows a status of the IHTI projectile of FIG. 9 shortly after the status shown in FIG. 15.

As shown in FIG. 16, dynamic pressure inside the casing 312 rises to a peak, and the FZU well or charging well 309 and the aft closure 902 are blown off the casing 312. The peak pressure can be, for example, up to 25,000 PSI in a BLU-109/B casing. Other peak pressures can be specified, depending on the particular design of the projectile and on the character of the target to be destroyed. Given that the casing 312 is the same as a BLU-109/B casing, at the point in time illustrated in FIG. 16, the casing 312 is accelerating forward (left) for a relative velocity change of about 100 feet per second, and the aft closure 902 is accelerated rearward for a relative velocity change of about 300 feet per second in the other direction.

Figure 17:
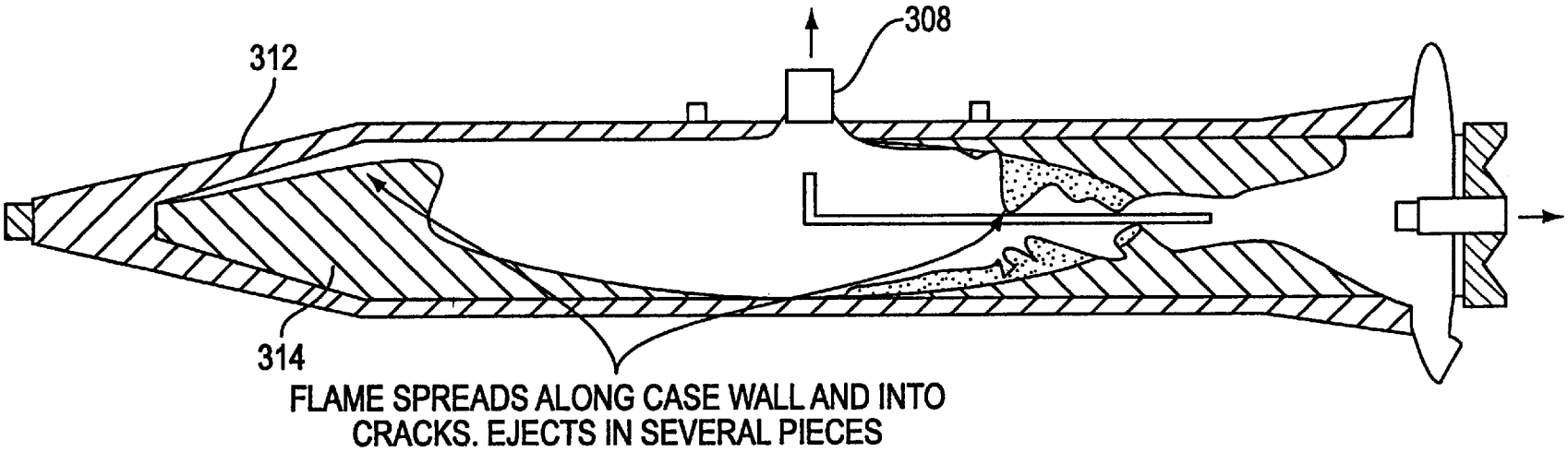
FIG. 17 shows a status of the IHTI projectile of FIG. 9 shortly after the status shown in FIG. 16

As shown in FIG. 17, the flame front continues to propagate along cracks in the incendiary and separations between the incendiary and the casing. The rear portion of the incendiary also begins to fracture into pieces, and will be ejected out the rear of the casing by gas pressure in the center of the casing.

Figure 18:
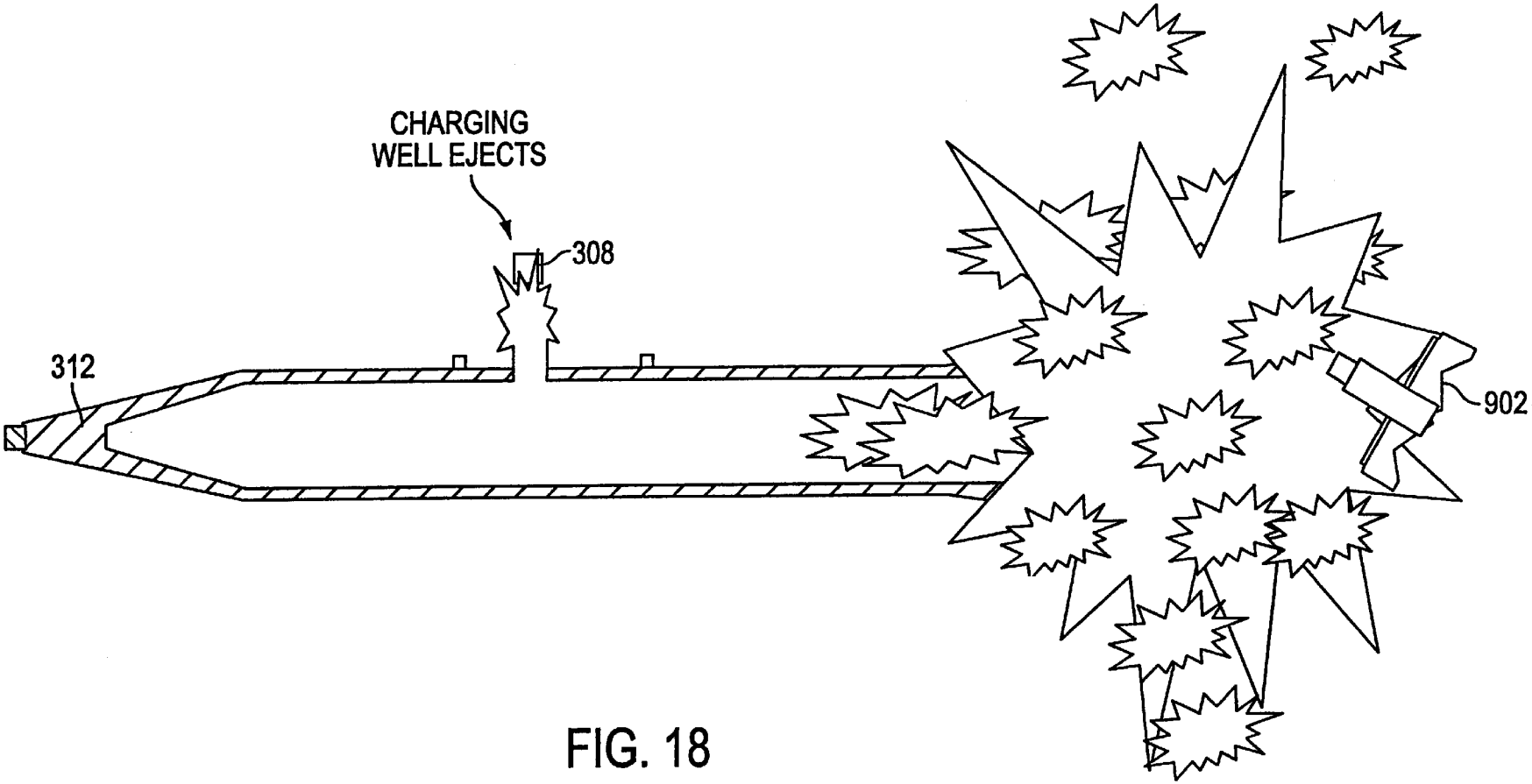
FIG. 18 shows a status of the IHTI projectile of FIG. 9 shortly after the status shown in FIG. 17.

As shown in FIG. 18, the charging well 309 containing the FZU 308 has finished ejecting from the casing, the forward portion of incendiary has burned, and hot combustion gases and pieces of burning incendiary have been expelled along with the aft closure 902 and fuze assembly within milliseconds after firing the fuze.

Figure 19:
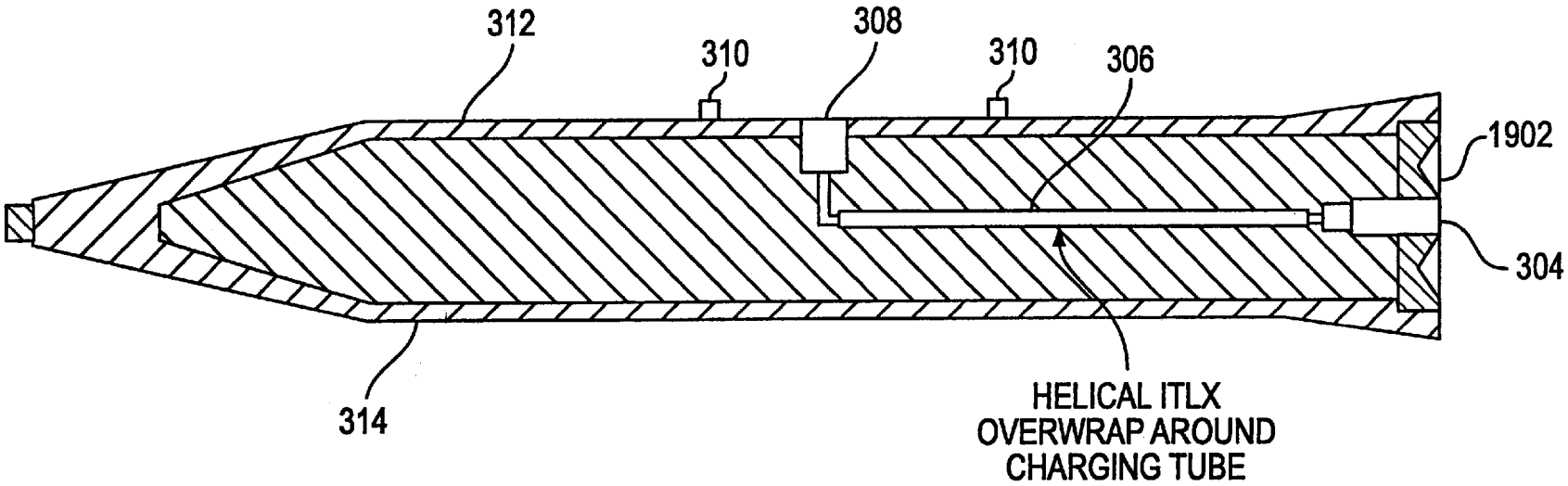
FIG. 19 shows an IHTI projectile according to another embodiment of the invention.

FIG. 19 shows an IHTI projectile similar to that shown in FIG. 9, with a aft closure 1902. The charging tube in the standard fuze plumbing 306 has ITLX or HIVILITE either inside the charging tube, or wrapped around the charging tube. ITLX or HIVILITE is an extremely fast, long, slender, flexible pyrotechnic charge that burns at a few thousand feet per second and gives off lots of hot sparks.

An IHTI projectile according to the invention can be used effectively on targets other than hard targets such as bunkers that contain biological or chemical agents. For example, the IHTI projectile can be used to attack oil refineries, petroleum storage facilities, ammunition dumps, bridges, and command-control-communications bunkers. Other suitable targets include buried facilities, missile silos, aircraft hangers, and ships.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. A method for attacking a target using an incendiary projectile, the projectile comprising a casing having a rear opening, an incendiary within the casing, a fuze for igniting the incendiary, and a closure occluding the rear opening, the method comprising the sequential steps of:

causing the projectile to collide with and penetrate the target;

igniting the incendiary using the fuze;

expelling the closure from the rear opening using gas pressure developed by incendiary reacting within the projectile; and dynamically ejecting at least a portion of reacting incendiary from the casing through the rear opening using gas pressure from the incendiary reacting within the casing, wherein the ejection disperses the ejected incendiary within the target.

2. The method of claim 1, further comprising the step of forming a chemical residue within the target using the incendiary, wherein the residue is capable of destroying at least one of a biological and a chemical agent.

3. The method of claim 1, wherein the projectile further comprises additional cargo, and the method further comprises a step of expelling the additional cargo through the rear opening into the target.

4. The method of claim 3, wherein the additional cargo comprises explosive submunitions, and the method further comprises the step of detonating each explosive submunition after a predetermined delay.

5. The method of claim 4, wherein at last some of the predetermined delays are different from others of the predetermined delays.

6. The method of claim 3, wherein the additional cargo comprises chemicals, and the method further comprises dispersing the chemicals within the target.

7. The method of claim 3, wherein the additional cargo comprises radioactive materials, and the method further comprises dispersing the radioactive materials within the target.

8. The method of claim 3, wherein the additional cargo comprises at least one of a radioactive device and an electric/electronic device, and the method further comprises activating the at least one device within the target.

9. The method of claim 3, wherein the additional cargo comprises at least one of radioactive materials, chemicals, an electric/electronic device, a radioactive device, and explosive submunitions.

10. A method for attacking a target using an incendiary projectile, the projectile comprising a casing having at least one aft vent, an incendiary within the casing, and a fuze for igniting the incendiary, the method comprising the steps of:

causing the projectile to collide with and penetrate the target;

igniting the incendiary using the fuze;

opening the at least one aft vent using gas pressure developed by incendiary reacting within the casing;

dynamically venting only hot reaction products from the incendiary reacting within the casing through the at least one vent to disperse the hot reaction products within the target.

11. A hard target incendiary projectile comprising:

a casing having a rear opening;

an incendiary within the casing; and a closure occluding the rear opening; wherein when the incendiary ignites and forms combustion products that increase pressure within the casing, an aperture is blown through the closure after the pressure within the casing rises above a predetermined level.

12. A hard target incendiary projectile comprising:

a casing having a rear opening;

an incendiary within the casing; and a closure occluding the rear opening; wherein when the incendiary ignites and forms combustion products within the casing, vents in the closure relieve pressure within the casing.

13. A hard target incendiary projectile comprising:

a casing having a rear opening;

an incendiary within the casing; and a closure occluding the rear opening; wherein when the incendiary ignites and forms combustion products that increase pressure within the casing, the rear opening opens after the pressure within the casing rises above a predetermined level.

14. The projectile of claim 1, further comprising at least one fuze having a high explosive booster for igniting the incendiary.

15. The projectile of claim 14, wherein the high explosive booster includes one of PBXN7, PBXN5 and Tetryl.

16. The projectile of claim 1, further comprising a void space between the closure and a surface of the incendiary sufficient to increase a violence of a pressure blow when the rear opening opens.

17. The projectile of claim 16, further comprising an auxiliary payload space inside the casing.

18. The projectile of claim 17, wherein the auxiliary payload space houses a least one of a chemical, a radioactive material, a radioactive device, an electric/electronic device, and fragmenting explosive submunitions.

19. The projectile of claim 18, wherein the submunitions are ejected from the casing when the closure blows off after impact with a target and later detonate to damage contents of the target so that heat generated by the projectile will have maximum destructive effect on the target contents.

20. The projectile of claim 19, wherein each submunition detonates after a predetermined delay.

21. The projectile of claim 20, wherein at least some of the submunition detonation delays are different from others of the submunition detonation delays.

22. The projectile of claim 1, wherein a body of the incendiary is formed with ports that enable a burn time duration of the incendiary within the casing to be controlled.

23. The projectile of claim 22, wherein the ports have a predetermined orientation.

24. The projectile of claim 1, wherein the projectile is designed to survive impact with an armored or concrete protected structure.

25. The projectile of claim 1, wherein the incendiary is a high explosive material that deflagrates when stimulated with a non-detonating flame igniter, and detonates when stimulated by an explosive booster.

26. The projectile of claim 1, wherein a chemical residue formed by the burning incendiary is capable of destroying biological or chemical agents.

27. The projectile of claim 1, wherein the incendiary is formed with cracks or ports to control propagation of a flame front upon ignition.

28. The projectile of claim 1, wherein the closure ejects out of the rear opening when the pressure rises above the predetermined level.

29. The projectile of claim 1, wherein the incendiary is a resilient solid mixture of at least one metal, an oxidant and a polymer binder.

30. The projectile of claim 1, wherein the incendiary is a solid and has a granular structure.

31. The projectile of claim 1, wherein a body of the incendiary includes an axially oriented opening extending forward from an aft end of the incendiary body and having a cross-sectional shape in the form of a slot.

32. The projectile of claim 1, further comprising at least one fuze having a deflagrating booster for igniting the incendiary.

33. The projectile of claim 1, further comprising at least one fuze located near an outer surface of the incendiary.

34. The projectile of claim 1, further comprising at least one fuze located at at least one of a fore end of the projectile, an aft end of the projectile, and a center of the projectile.

35. The projectile of claim 1, wherein a portion of the incendiary is expelled ignited but only partially reacted out the rear opening after the closure ejects while the unexpelled portion of the incendiary continues to burn within the casing.

36. The projectile of claim 1, wherein the incendiary reacts within the casing in the absence of air or gaseous oxygen.

37. The projectile of claim 1, wherein an outer surface of the incendiary is at least partially bonded to an inner surface of the casing.

38. The projectile of claim 1, wherein the incendiary is rigid.

39. The projectile of claim 1, wherein the incendiary is resilient.

* * * * *

UNITED STATES PATENT AND TRADEMARK OFFICE

CERTIFICATE OF CORRECTION

PATENT NO. : 6,105,505
DATED : August 22, 2000
INVENTOR(S) : John Willis Jones

It is certified that error appears in the above-identified patent and that said Letters Patent is hereby corrected as shown below:

Make the following changes:

Claim 14,
Line 1, change "of claim 1" to -- of claim 13 --.

Claim 16,
Line 1, change "of claim 1" to -- of claim 13 --.

Claim 22,
Line 1, change "of claim 1" to -- of claim 13 --.

Claim 24,
Line 1, change "of claim 1" to -- of claim 13 --.

Claim 25,
Line 1, change "of claim 1" to -- of claim 13 --.

Claim 26,
Line 1, change "of claim 1" to -- of claim 13 --.

Claim 27,
Line 1, change "of claim 1" to -- of claim 13 --.

Claim 28,
Line 1, change "of claim 1" to -- of claim 13 --.

Claim 29,
Line 1, change "of claim 1" to -- of claim 13 --.

Claim 30,
Line 1, change "of claim 1" to -- of claim 13 --.

Claim 31,
Line 1, change "of claim 1" to -- of claim 13 --.

Claim 32,
Line 1, change "of claim 1" to -- of claim 13 --.

UNITED STATES PATENT AND TRADEMARK OFFICE

CERTIFICATE OF CORRECTION

PATENT NO. : 6,105,505
DATED : August 22, 2000
INVENTOR(S) : John Willis Jones

It is certified that error appears in the above-identified patent and that said Letters Patent is hereby corrected as shown below:

Claim 33,
Line 1, change "of claim 1" to -- of claim 13 --.

Claim 34,
Line 1, change "of claim 1" to -- of claim 13 --.

Claim 35,
Line 1, change "of claim 1" to -- of claim 13 --.

Claim 36,
Line 1, change "of claim 1" to -- of claim 13 --.

Claim 37,
Line 1, change "of claim 1" to -- of claim 13 --.

Claim 38,
Line 1, change "of claim 1" to -- of claim 13 --.

Claim 39,
Line 1, change "of claim 1" to -- of claim 13 --.

Signed and Sealed this

Eighteenth Day of December, 2001

*Attest:*

*Attesting Officer*

JAMES E. ROGAN
*Director of the United States Patent and Trademark Office*